US010801094B2

(12) United States Patent
Chen et al.

(10) Patent No.: US 10,801,094 B2
(45) Date of Patent: Oct. 13, 2020

(54) GRAIN BOUNDARY ENGINEERING OF POLYCRYSTALLINE SHAPE MEMORY ALLOYS BY PHASE MANIPULATION FOR ENHANCED MECHANICAL DUCTILITY AND APPLICATION FATIGUE LIFE

(71) Applicant: RENSSELAER POLYTECHNIC INSTITUTE, Troy, NY (US)

(72) Inventors: Ying Chen, Latham, NY (US); Rebecca Dar, Troy, NY (US)

(73) Assignee: Rensselaer Polytechnic Institute, Troy, NY (US)

( * ) Notice: Subject to any disclaimer, the term of this patent is extended or adjusted under 35 U.S.C. 154(b) by 197 days.

(21) Appl. No.: 15/525,128

(22) PCT Filed: Nov. 6, 2015

(86) PCT No.: PCT/US2015/059415
§ 371 (c)(1),
(2) Date: May 8, 2017

(87) PCT Pub. No.: WO2016/118213
PCT Pub. Date: Jul. 28, 2016

(65) Prior Publication Data

US 2018/0274071 A1 Sep. 27, 2018

Related U.S. Application Data

(60) Provisional application No. 62/076,022, filed on Nov. 6, 2014.

(51) Int. Cl.
*C22F 1/08* (2006.01)
*C22F 1/10* (2006.01)
(Continued)

(52) U.S. Cl.
CPC ..... *C22F 1/006* (2013.01); *C21D 1/26* (2013.01); *C22C 9/01* (2013.01); *C22C 19/07* (2013.01);
(Continued)

(58) Field of Classification Search
None
See application file for complete search history.

(56) References Cited

U.S. PATENT DOCUMENTS

2003/0079814 A1 5/2003 Harchekar et al.
2005/0016642 A1 1/2005 Oikawa et al.
2010/0140439 A1 6/2010 Schuh et al.

OTHER PUBLICATIONS

Hodgson et al., "Shape Memory Alloys," 1990, pp. 897-902, ASM Handbook, vol. 2: Properties and Selection: Nonferrous Alloys and Special-Purpose Materials.
(Continued)

*Primary Examiner* — Brian D Walck
(74) *Attorney, Agent, or Firm* — Murtha Cullina LLP; Anthony P. Gangemi

(57) ABSTRACT

Provided is a method of making a polycrystalline shape memory alloy (SMA) by forming an alloy with grains and boundaries between them, exposing the alloy to a two-phase temperature range at which a two-phase equilibrium is achieved in the alloy, converting grains to an austenite phase, and precipitating a face-centered-cubic crystal structure solid solution phase at grain boundaries, then quenching the alloy. Also provided is a polycrystalline SMA with a dual-phase microstructure having grains mostly in an austenite phase, a martensite phase, or in transition between an austenite phase and a martensite phase and grain boundaries containing a face-centered-cubic crystal structure solid solution phase.

5 Claims, 9 Drawing Sheets

(51) Int. Cl.

| | |
|---|---|
| ***C21D 1/26*** | (2006.01) |
| ***C22C 9/01*** | (2006.01) |
| ***C22C 19/07*** | (2006.01) |
| ***C22F 1/00*** | (2006.01) |

(52) U.S. Cl.
CPC ..... *C22F 1/08* (2013.01); *C22F 1/10* (2013.01); *C21D 2201/01* (2013.01); *C21D 2211/008* (2013.01)

(56) References Cited

OTHER PUBLICATIONS

Raghavan, "Al—Co—Ni (Aluminum-Colbalt-Nickel)," 2006, pp. 372-380, Journal of Phase Equilibria and Diffusion, vol. 27, No. 4.
Ghosh et al., "Aluminium-Copper-Zinc," 2005, pp. 182-205, Ternary Alloy Systems: Phase Diagrams, Crystallographic and Thermodynamic Data.
Prince et al., "Aluminum-Copper-Nickel," 2005, pp. 104-126, Ternary Alloy Systems: Phase Diagrams, Crystallographic and Thermodynamic Data.
Patent Cooperation Treaty, International Search Report for PCT/US2015/059415 dated Jul. 22, 2016, 3 pages.
Patent Cooperation Treaty, Written Opinion of the International Searching Authority for PCT/US2015/059415 dated Jul. 22, 2016, 5 pages.
Dar et al., "Nanoindentation studies of small-scale martensitic transformations and ductile precipitate effects in dual-phase polycrystalline shape memory alloys," 2015, pp. 112-127, ScienceDirect, Acta Materialia.

GRAIN BOUNDARY ENGINEERING OF POLYCRYSTALLINE SHAPE MEMORY ALLOYS BY PHASE MANIPULATION FOR ENHANCED MECHANICAL DUCTILITY AND APPLICATION FATIGUE LIFE

CROSS-REFERENCE TO RELATED APPLICATIONS

This application is the National Phase filing under 35 U.S.C. § 371 of and claims priority to International Application No. PCT/US2015/059415 filed on Nov. 6, 2015 and published as International Publication No. WO2016/118213A2 on Jul. 28, 2016, and claims priority to U.S. Provisional Application No. 62/076,022, filed Nov. 6, 2014, which applications are herein incorporated by reference in their entireties.

GOVERNMENT RIGHTS STATEMENT

This invention was made with U.S. Government support under NSF-DMR 1352524 awarded by the National Science Foundation. The U.S. Government has certain rights in the invention.

BACKGROUND OF THE INVENTION

Technical Field

The present invention generally relates to use shape memory alloys (SMAs). More particularly, the present invention relates to dual-phase polycrystalline SMAs with a matrix of grains having present in one phase and grain boundary interfaces consisting of another phase, with effects on mechanical ductility and fatigue life.

Background Information

Shape Memory Alloys (SMAs) hold great promise for actuation, sensing, and damping applications, among others. They can sustain large strains when a force is applied, and recover their prior shape and dimensions upon removal of the mechanical load or application of heating. This response is enabled by a reversible structural transformation, called martensitic phase transformation, through which austenite and martensite phases with different crystal structures convert between each other mainly by a shear. However, during stress-induced transformation different grains may shear in different directions, which often induces strain incompatibility and stress concentration at grain boundaries, leading to intergranular fracture. Grain boundaries are internal structure defects (i.e., the disordered interfacial regions separating grains/crystals having different orientations) present in all polycrystalline materials. As a result, strain incompatibility arises in almost all polycrystalline SMAs, leading to the propensity for fracture along grain boundaries. It is therefore desirable to develop polycrystalline SMA alternatives that are not only ductile but low cost.

SUMMARY OF THE INVENTION

The shortcomings of the prior art are overcome, and additional advantages are provided, through the provision, in one aspect, of a method of making a polycrystalline SMA. The method includes forming an alloy by combining a plurality of metals, where the alloy comprises a matrix of grains and a plurality of grain boundaries and the plurality of grain boundaries comprise a plurality of interfaces between adjacent grains; exposing the alloy to a two-phase temperature range at which the alloy comprises a two-phase equilibrium; exposing the alloy to a dwell temperature within the two-phase temperature range for a duration of time; converting at least most of the matrix of grains to an austenite phase; precipitating a face-centered-cubic crystal structure solid solution phase at the plurality of grain boundaries; and quenching the alloy.

A polycrystalline SMA is also provided. The polycrystalline SMA includes an alloy which is a plurality of metals; a dual-phase microstructure within the alloy having a matrix of grains and a plurality of grain boundaries. The matrix of grains has a plurality of grains that are at least mostly in an austenite phase, at least mostly in a martensite phase, or at least mostly transitioning between an austenite phase and a martensite phase, and the plurality of grain boundaries contain a face-centered-cubic crystal structure solid solution phase at a plurality of interfaces between adjacent grains.

Additional features and advantages are realized through the techniques of the present invention. These and other objects, features and advantages of this invention will become apparent from the following detailed description of the various aspects of the invention taken in conjunction with the accompanying drawings.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION OF THE INVENTION

Figure 1A:
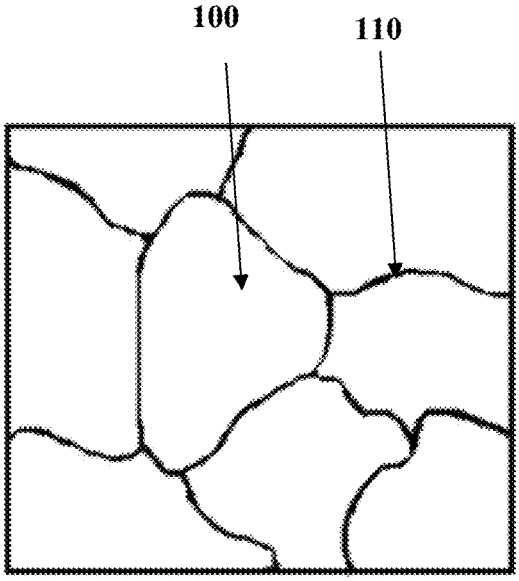
FIG. 1A is a diagrammatic representation of conventional polycrystalline SMA with an austenitic (β) phase grain structure and bare grain boundaries.

Aspects of the present invention and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the invention in detail. It should be understood, however, that the detailed description and the specific examples, while indicating embodiments of the invention, are given by way of illustration only, and are not by way of limitation. Various substitutions, modifications, additions and/or arrangements within the spirit and/or scope of the underlying inventive concepts will be apparent to those skilled in the art from this disclosure.

The present disclosure provides, in part, polycrystalline SMAs possessing a matrix of grains and grain margins, or inter-grain boundaries, in which grain margins have a face-centered-cubic crystal structure solid solution phase, referred to herein as a second phase, and a method for the manufacture of such polycrystalline SMAs. A grain is a crystallite in which atoms form periodic arrays. A polycrystalline material consists of many grains that are oriented in different directions. The functionality of SMAs is enabled by a reversible phase change called martensitic transformation. The effect on martensitic transformation of a second phase at the margins of grains in accordance with the present invention significantly and favorably impacts the functionality of polycrystalline SMAs. In the present invention, grains of an SMA are at least mostly in an austenite phase, mostly in a martensite phase, or mostly in transition between an austenite phase and a martensite phase, depending on the temperature and application of external force, and at least mostly not containing aspects in a face-centered-cubic crystal structure solid solution (i.e., second) phase. SMAs possessing the foregoing characteristics may desirably be less brittle, less susceptible to fracturing, more ductile, greater workability, have a longer fatigue life, and be more cost effective to manufacture than conventional SMAs.

A face-centered-cubic crystal structure solid solution (i.e., second) phase is sometimes referred to as a γ phase, such as in cobalt-based SMAs, and sometimes referred to as an a phase, such as in copper-based SMAs. An austenite phase is sometimes referred to as a β phase and a martensite phase is sometimes referred to as a β' phase. Herein, grains may be referred to as having a β, or austenite, phase, meaning they are at least mostly in an austenite phase when exposed to a temperature above the martensitic start temperature and there is no external force being applied. It would be understood, however, that such grains could be transformed into an at least mostly martensite phase, or at least mostly transitioning between an austenite phase and a martensite phase, depending on the temperature the SMA is exposed to and the grains' martensitic and austenitic start and finish temperatures, as well as the application of any external force to the SMA. Referring to such grains herein as being in an austenite, or β, phase is intended to encompass grains with the ability to transition between an austenite and martensite phase depending on temperature and force application, which is a characteristic of SMAs.

Figure 1B:
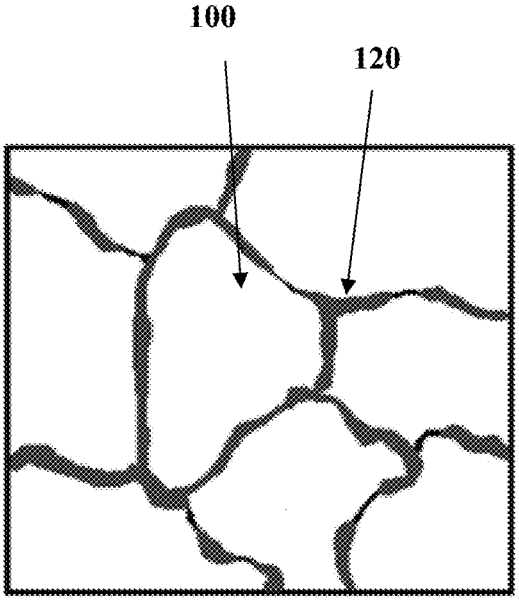
FIG. 1B is a diagrammatic representation of a grain boundary-engineered polycrystalline SMA with a thin layer of a face-centered-cubic crystal structure solid solution phase (γ) precipitated along β grain structure in accordance with the present invention.

As shown herein, according to the present invention, a ductile second phase is precipitated into a matrix β phase microstructure and the volume, distribution, and morphology of precipitates is controlled such that they primarily precipitate along grain boundaries. The effect of this grain boundary engineering strategy is shown schematically in FIG. 1. FIG. 1A is a diagrammatic representation of a conventional polycrystalline SMA with β grains 100 and bare grain boundaries 110. FIG. 1B is a diagrammatic representation of a grain boundary engineered SMA material with a thin layer of second phase 120 precipitated along the margins of β grains 100 in accordance with the present invention. As conventional bare grain boundaries usually oppose martensitic phase transformations, precipitating the second phase along grain boundaries in accordance with the present invention reduces the energy barrier for transformation and improves shape memory properties. The second phase also opposes growth of cracks along grain boundaries and improves the ductility of the SMA significantly. As demonstrated herein, grain boundaries are thereby largely replaced with a thin layer of a secondary, softer phase, without requiring mechanical deformations of components with complex geometry in the industry.

A preferred microstructure can be achieved by carrying out a thermal treatment at relatively high temperatures within the temperature range where two-phase equilibrium exists for an alloy that possesses shape memory characteristics. Some examples of such alloys, which are known to in the art, include copper-zinc-aluminum, copper-zinc-tin, copper-zinc-gallium, copper-zinc-silicon, copper-aluminum-nickel, copper-aluminum-beryllium, copper-aluminum-manganese, cobalt-nickel-aluminum, cobalt-nickel-gallium, nickel-aluminum, nickel manganese gallium, nickel-manganese-aluminum, nickel-iron-gallium, iron-manganese-aluminum-nickel, iron-nickel-cobalt-titanium, iron-nickel-cobalt-aluminum, and nickel-titanium, with various possible relative percentages by weight of constituent metals in such alloys yielding SMAs with differing qualities.

In accordance with the present invention, phase diagrams and their isothermal sections may be consulted to identify relative proportions of constituent metals in known SMAs and thermal treatment of such alloys, at which a two-phase equilibrium can be obtained. Examples of such phase diagrams and isothermal sections and methods for their creation for particular alloys are well known to those having skill in the relevant field. Examples of such phase diagrams and isothermal sections are abundantly available in publicly accessible literature and databases. Examples can be found in the following references, among others: Dar & Chen (2015), Acta Materialia, 91:112-127, which is incorporated herein by reference in its entirety; Kainuma R, Ise M, Jia C C, Ohtani H, Ishida K. (1996), Intermetallics, 4:S151; Zhao X, Qi M, Yang D. J. Mater (1990), Sci. Technol., 6:427; Lojen G, Anžel I, Kneissl A, Križman A, Unterweger E, Kosec B, Bizjak M. (2005), Journal of Materials Processing Technology 2005; 162-163:220-229. Examples are also available to the public from professional societies, such as the ALLOY PHASE DIAGRAM DATABASE™, published by ASM International (formerly known as the American Society for Metals).

Figure 2A:
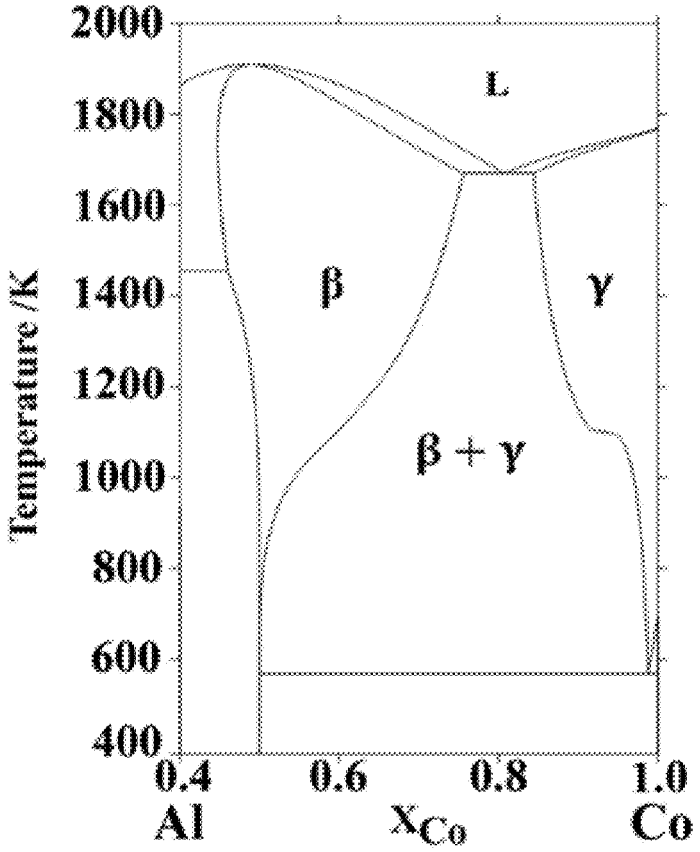
FIG. 2A is a cobalt-aluminum alloy phase diagram.
Figure 2B:
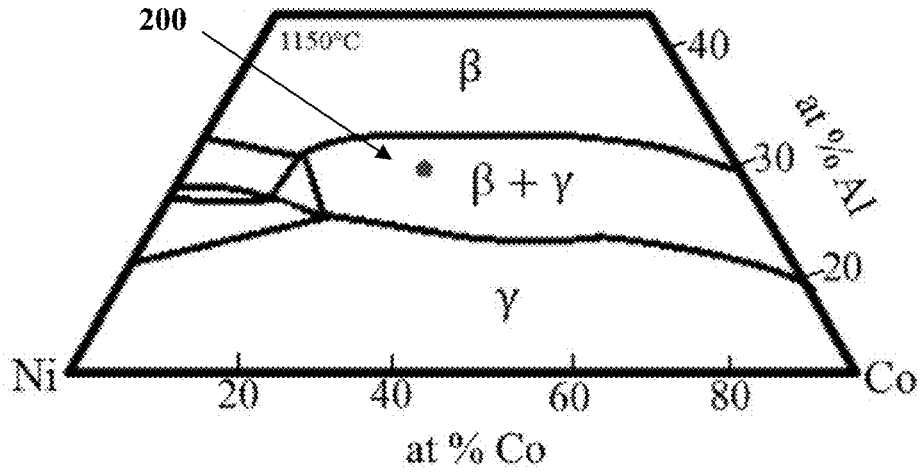
FIG. 2B is a schematic isothermal section of Co—Ni—Al ternary phase diagram at 1150° C.

One example of a phase diagram useful for selecting relative proportions of metals in an SMA and temperature for inducing a two-phase equilibrium in accordance with the present invention is shown in FIG. 2A, which is a phase diagram for a cobalt-aluminum alloy. Shown are phases at various temperatures for different relative proportions by weight of cobalt and aluminum in such alloy. At certain temperatures for particular relative proportions of cobalt and aluminum in an alloy, a β phase is preferentially formed. At other temperatures and/or relative proportions, a γ phase is preferentially formed. At still other temperatures and relative proportions, however, a dual-phase equilibrium is preferentially formed at which both a β phase and a γ phase coexist as the preferred low energy states. A nickel-aluminum alloy has a quite similar phase diagram as that for cobalt-aluminum. Therefore in a cobalt-nickel-aluminum SMA, the dual-phase β+γ equilibrium region encompasses easily identifiable compositions and temperatures. A schematic isothermal section of a cobalt-nickel-aluminum ternary phase diagram at 1150° C., shown in FIG. 2B, illustrates an exemplar temperature and relative metal proportion for attaining such dual-phase β+γ equilibrium. One such relative metal proportion 200, $Co_{37}Ni_{35.5}Al_{27.5}$, is shown in FIG. 2B (where subscripts indicate % composition of each metal in the alloy by atomic percent). A cobalt-nickel-aluminum SMA at these relative proportions of cobalt, nickel, and aluminum would be predicted to form a dual-phase equilibrium of β+γ phases at 1150° C.

Skilled artisans would also recognize that SMAs other than cobalt-nickel-aluminum, containing only some or none of the metals present in a cobalt-nickel-aluminum alloy, or containing them at proportions different than $Co_{37}Ni_{35.5}Al_{27.5}$, may also be used in accordance with their own phase diagrams and isothermal sections in accordance with the present invention. Similar analyses of phase diagrams and isothermal sections of other SMAs can be performed to identify other relative proportions of SMAs' constituent metals and temperatures for forming dual-phase β+γ equilibriums therein in accordance with the present invention and would be well within the capabilities of those with skill in the relevant fields.

To induce a dual-phase austenite-and-second-phase equilibrium, an SMA is exposed to a temperature within a range at which such equilibrium is accomplished for a given relative proportion of metals in a given alloy. For a given SMA with a given proportion of metal constituents, a temperature within the dual-phase temperature range may be selected and the SMA exposed to that temperature for a period of time before the SMA is quenched by, for example, being submerged in ice water. Applying a quenching procedure after heat treatment helps create interior grain regions that are not in the second phase nor in other undesirable phases and will be in the austenite phase when the temperature is above the martensitic start temperature. A temperature may be selected that is between a lower temperature limit and upper temperature limit at which a dual-phase austenite-and-second-phase equilibrium may be obtained. The chosen temperature may be above such lower temperature limit by between 50%-60% of the difference, between 50%-80% of the difference, or between 50%-95% of the difference between such lower temperature limit and such higher temperature limit. The dual-phase equilibrium temperature chosen for prolonged exposure, referred to as a dwell temperature, may be more than approximately 50%, more than approximately 60%, more than approximately 80%, or more than approximately 95% of the difference between such lower temperature limit and such higher temperature limit. In other cases, a dwell temperature may be less than approximately 50% of the difference between such lower temperature limit and such higher temperature limit.

Exposure to temperatures in a dual-phase equilibrium temperature range leads to formation of austenite β grains and precipitation of a face-centered-cubic crystal structure solid solution phase at grain interfaces or margins. In some cases, the higher the dwell temperature, the greater the fraction of precipitation of a second phase that forms at grain boundaries. However, in some cases, too high a temperature may result in precipitates of a second phase at grain boundaries that, unsatisfactorily, are too thin, too discontinuous, or both. In such cases, an SMA may be exposed to an initial temperature within a dual-phase equilibrium temperature range that is at the higher end of the range at which initial precipitation of a second phase at grain boundaries is favored (a higher dwell temperature), then the exposure temperature may be systematically lowered before a second, lower temperature within the dual-phase equilibrium temperature range is attained and held for another period of time (a lower dwell temperature). In this way, a second phase precipitation at grain boundaries may initially be promoted by exposure to the higher dwell temperature, then sequential exposure to lower temperatures may promote further precipitation of a second phase at boundaries rendering such precipitates desirably thicker and more continuous. More than two dwell temperatures may also be used in some circumstances (e.g., high dwell temperature, medium dwell temperature, and low dwell temperature).

Where such multiple dwell temperatures are employed, all may be more than 50% higher than half of the difference between a lower temperature limit and upper temperature limit of the dual-phase equilibrium temperature range. In some examples, a first temperature may be above the dual-phase equilibrium temperature range, then the temperature may be sequentially ramped down to a lower dwell temperature within the dual-phase equilibrium temperature range. In other cases, a dwell temperature may be above the lower temperature limit of a dual-phase equilibrium temperature range by less than 50% of the difference between such lower limit temperature and the upper limit temperature of the range. For example, a dwell temperature may be between 10% and 50% of such difference between a lower temperature limit and a higher temperature limit. In some cases, an SMA may first be exposed to a temperature that is above an upper temperature limit of its dual equilibrium temperature range and the exposure temperature systematically lowered to within its dual equilibrium temperature range. In such a scenario, a second phase may begin to precipitate at grain margins upon exposure to a temperature within the dual phase equilibrium and the second phase at grain margins may thicken and/or become more continuous as temperature continues to be lowered. The temperature may be held at one or more dwell temperatures during this process.

The duration of time for which an SMA is exposed to a dwell temperature, or dwell time, may be within several minutes up to 10 hours or more. In some instances, between 1.5-3 hours is a preferable dwell time. In others, a dwell time of between 2-4 hours may be preferable. For certain SMAs and certain temperatures, dwell times of less than 1.5 hours or more than 4 hours may be preferable. Sometimes a dwell time of more than 10 hours may be preferable. If multiple dwell temperatures are used, a dwell time at one such dwell temperature may be different than a dwell time at another temperature.

The rate at which temperature is adjusted from one temperature to another may also be varied. For example, a rate of temperature change from one exposure temperature to another, or from one dwell temperature to another, may be between 0.8° C./min and 2.5° C./min. Such rate may also be between 0.2° C./min and 0.5° C./min, or 2.5° C./min and 5° C./min. Rates of temperature change may also be varied. Additionally, temperature may ramp up to a dwell temperature during exposure of an SMA, rather than, for example, heating a furnace to a dwell temperature before placing an SMA in such furnace. Different temperature ramp-down and ramp-up regimes may be employed to adjust the thickness, continuity, or both of grain boundary second-phase precipitates. In addition, it may be difficult to completely eliminate all second-phase precipitation within the matrix of β grains and contain all second-phase precipitation exclusively at grain boundaries. Adjusting ramp-up and ramp-down temperature rates may be effective in minimizing γ phase precipitation within β grains, when desirable.

Increasing temperature to which an SMA is exposed to promote formation of a dual-phase equilibrium may decrease the overall second-phase fraction, desirably increase the tendency to precipitate a second phase along grain boundaries, and decrease the tendency to precipitate a second phase within grains. Increasing temperature to which an SMA is exposed to promote formation of a dual-phase equilibrium may also change the transformation temperature (temperature at which SMA in martensitic state transforms into austenitic state). For example, an increase of 50° C. in thermal treatment temperature (from 1150° C. to 1200° C. for a 24 hours heat treatment of an SMA alloy comprising $Co_{37}Ni_{35.5}Al_{27.5}$) increased transformation temperature by 90° C.

Increasing the duration of exposure to a temperature promoting formation of a dual-phase equilibrium may increase the volume fraction of the second phase precipitates, increase the tendency to form continuous precipitates along grain boundaries, and increase the tendency to form larger and/or longer precipitates inside grains. It may also change transformation temperature slightly.

Increasing the rate at which a furnace in which an SME is exposed to a temperature promoting formation of a dual-phase equilibrium is ramped up to such temperature while the SMA is present in the furnace may reduce the amount of time spent at temperatures lower than such temperature and therefore decrease the tendency to precipitate a second phase inside grains. It may also change the transformation temperature. For example, when such ramping-up rate is increased by 0.5° C./min, transformation temperature may increase by about 60° C.

Changing the metal composition of SMA may change the volume fraction, connectivity, and dispersion of second phase precipitates. Increasing cobalt and aluminum content may also lead to a change in transformation temperature.

Depending on the metals contained in the SMA, their weight proportion, and the phase diagrams and isothermal sections thereof, those possessing skill in the relevant field would be capable of adopting different temperature exposures, dwell temperatures, dwell times, and ramp-up and -down rates befitting their particular needs for a preferred SMA and its grain boundary properties.

A second phase at grain margins may enhance shape memory effects. As grain boundaries usually oppose martensitic phase transformations, precipitating a second phase along grain boundaries may reduce the energy barrier for transformation and improve shape memory properties. Regions of β adjacent to second-phase precipitates may exhibit higher recovery than regions of β without second-phase precipitates nearby. Strain recovery is the recoverable displacement normalized by the total displacement, and superelastic strain recovery is a measure of a material's ability to recover imposed stain by undergoing reversible martensitic transformation. Higher hardness and lower energy dissipation both indicate that less unrecoverable plastic deformation and more recoverable elastic and superelastic deformation has occurred in regions of β surrounded with or "cushioned" by a second phase.

SMA's and their manufacture in accordance with the present invention have numerous potential uses. Shape memory alloy thin films or sheets can be used as solid-state micro-actuators, micro-pumps, micro-grippers, micro-endoscopes and micro-valves in microelectromechanical devices, such as in plumbing and home appliance, surgical tool, and aerospace applications. Many of these devices have two states "memorized," a low temperature deformed state and a high temperature state that recovers to a finite strain, which is an improvement over existing technology which can only perform in one physical state and is unable to recover imposed strain. SMA actuators often can be fabricated as one component and can be made extremely small, whereas most conventional actuators require many parts to be machined. SMA micro-grippers, for example, may be used to assemble sub-millimeter lenses, and anti-scald valves in taps and showerheads may employ SMAs to block fluid flow when the fluid temperature increases above a dangerously high value.

In accordance with the present invention, SMAs may also be used as active clearance control systems to close a gap between aircraft turbine blades and the shroud, reducing leakage of air past the blade in commercial aircraft systems. SMAs respond to changes in temperature and stress and can achieve high recoverable strains of several percent and are also easily formed into different geometries, making them desirable for the small spaces required to provide active clearance control in commercial aircraft. In addition, employing SMA wires for active clearance control may reduce exhaust gas temperature overshoot during aircraft take-off, which would improve hot-section on-wing components and increase the time between engine overhauls Also in accordance with the present invention, SMAs may be used in cryofit couplings, which are expanded (deformed) while in the martensitic state at very low temperatures and have an inner diameter that is smaller than the inner diameter of a hydraulic tube in which they will fit. They are installed in hydraulic fluid tubes in the martensitic state and as they are allowed to come to room temperature, form a tight seal around the inner wall of the hydraulic tube. Cryofit couplings made from SMAs in accordance with the present invention have lower weight than conventional, can be more easily formed into a variety of shapes, and form a tighter seal between hydraulic tubes than conventional cryofit couplings.

In further accordance with the present invention, SMA heat engines may use waste-heat given off by the engine by converting a temperature change into mechanical energy. Alternatively, SMAs manufactured in accordance with the present invention may also be coupled with piezoelectric materials to form a pyroelectric composite that can generate electricity when temperature changes. This technology reduces oil consumption by utilizing waste-heat for mechanical energy output or to drive an electric generator. In addition, if applied, it could reduce carbon dioxide emissions in vehicles significantly. It may be applied in, for example, automobiles, HVAC systems, and industrial generators.

In further accordance with the present invention, SMA wires and cables may be incorporated into suspension bridges to absorb vibrations which cause structural instability. SMA tendons may also be used for structural supports in buildings susceptible to seismic vibrations. SMAs manufactured in accordance with the present invention may absorb seismic energy during an earthquake and impose a righting moment to the structure following the passage of a shock wave.

SMAs manufactured in accordance with the present invention may also be fabrics composed of 100% SMA yarn or composite structures consisting of SMA with polymeric or metallic yarns. Such structures may be applicable in, for example, damping applications. SMA fabrics are an improvement on conventional fabrics because there may be a significant increase in energy absorption by the addition of only a small percentage of SMA yarn by volume to conventional fabrics. SMA fabrics may also be embedded in fiberglass or carbon fiber composites and knit or woven with other fabrics to improve impact resistance of motorcycle helmets ballistic resistance materials.

Owing in part to their superelastic properties (i.e., their ability to recover their prior shape when a load is removed and resist permanent strain and bending deformation), SMAs made in accordance with the present invention may also be used in cellular phone antenna, spacecraft antenna, eyeglass wire frames, orthodontic wires, and underwire for brasseries. SMAs are desirable due to their ability to conform to the human body (underwire), change their length over time to reduce the need for wire tightening (orthodontic wires), and recover deformation imposed during usage (antenna, eyeglass frames). Conventional wires do not have the ability to regain their shape when a load is removed and are not designed for maximum comfort for each individual.

Thus, an SMA manufactured in accordance with the present invention may be formed into an article such as a rod, a bar, a wire, a wire cloth, a woven fabric, a foil, a ribbon, a sheet, a porous alloy, a foam, or a tube, for use in, for example, any of the foregoing applications, or others for which their desirable properties are deemed beneficial.

EXAMPLES

Aspects of the present invention now will be further illustrated by, but by no means are limited to, the following Examples.

Example 1: Cobalt-Nickel-Aluminum SMA

Procedure

Cylindrical ingots of $Co_{37}Ni_{35.5}Al_{27.5}$ at % were prepared by arc melting and casting in a copper chill mold in high purity argon. The as-prepared polycrystalline alloy was subject to a thermal treatment in argon with 1% hydrogen at 1150° C. for 24 hours, ramped up from room temperature (25° C.) at a rate of 1.5° C./min with the allow present in the furnace. A schematic isothermal section of Co—Ni—Al ternary phase diagram at 1150° C., with relative metal proportion 200 of $Co_{37}Ni_{35.5}Al_{27.5}$ located in a β+γ dual-phase regime, is shown in FIG. 2B. From analysis of the phase diagram and use of known tie lines, it is expected that approximately 18-20 wt % γ exists in equilibrium with β as a result of this thermal processing.

A Differential Scanning calorimeter (TA instruments DSC-Q2000) was used to measure martensitic transformation temperatures with a temperature ramping rate of 2° C./min. Transformations were further confirmed by in-situ X-Ray Diffraction (XRD). XRD patterns were collected with Cu-Kα radiation using a Bruker D8-Discover Diffractometer equipped with a thermally-controlled stage capable of reaching temperatures in the range of −100° C. to 200° C. Scans were collected at temperatures of 25° C., −30° C., −75° C., −90° C., and −100° C. Samples were mounted in epoxy containing conductive graphite particles, grinded and polished, and were then lightly etched. Optical microscopy was conducted using a LECO Olympus PMG-3 inverted microscope at 500× magnification. Imaging and grain orientation mapping were carried out using a Carl Zeiss Ultra 1540 Scanning Electron Microscope (SEM) equipped with a NordlysNano Electron Backscatter Diffraction (EBSD) detector; the sample was tilted 70° and a scan step size of 1 μm (0.1 μm for select areas) was used. Composition information was acquired by an Oxford INCA Energy 250 EDX detector. Orientation and composition analyses were conducted using the AZtecHKL software.

Nanoindentation was conducted at room temperature using a TI 900 HYSITRON TRIBOINDENTER® equipped with a diamond Berkovich tip that has a three-sided pyramid shape. The Berkovich tip was chosen over other nanoprobe tips for two reasons. It has a relatively small radius (~50-200 nm) which is desired for probing local precipitate/matrix behavior at small length scales. Additionally, its three-sided pyramid shape creates a residual indent in the sample, making the region of indentation easy to identify for post-indent imaging. Specific grains were selected for indenting using the optics of the nanoindenter. Scanning Probe Microscopy (SPM) in the nanoindenter was used to image and select areas to indent and also to image indents after each test was completed. The setpoint force was 2 μN and scan rate was 1.50-1.70 Hz. Automatic methods were used to create linear patterns of indents with an indent spacing of 1.25 μm, 1.8 μm, 2.0 μm, 2.1 μm, or 2.3 μm in different sets of tests. Load-controlled tests were carried out by following a load function that incorporates a 30 second hold at 0.1 μN before ramping at a constant rate of 14 μN/s to a peak load of 800 μN or 1000 μN, followed by unloading at the same constant rate to zero load. Such low loads induce less plasticity beneath the tip, making martensitic transformation more apparent.

Dual-Phase SMA Microstructure

A $Co_{37}Ni_{35.5}Al_{27.5}$ at % alloy was fully austenitic at room temperature. Upon cooling, the martensite start and finish temperatures were $M_s \approx -45°$ C. and $M_f \approx -80°$ C. Upon heating, austenite start and finish temperatures were $A_s \approx -50°$ C. and $A_f \approx -21°$ C. A series of XRD diffraction patterns showed peaks for austenite β (B2), martensite β' ($L1_0$), and γ phases. At 25° C., the largest peak appeared at approximately 45° and corresponds to $(110)_{B2}$. As temperature was decreased, characteristic peaks associated with austenite (B2) weakened while characteristic peaks of martensite ($L1_0$) emerged and grew in intensity. As temperature was decreased to −75° C. and below (−90° C. and −100° C.), martensite peaks became more pronounced.

Figure 3A:
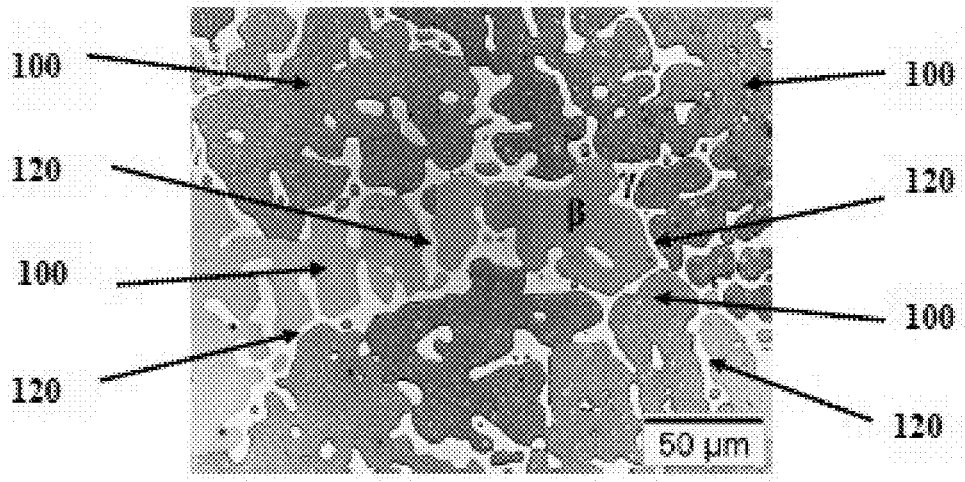
FIGS. 3A and 3B are optical microscopic images of a dual-phase β+γ microstructure in a cobalt-nickel-aluminum SMA in accordance with the present invention.
Figure 3B:
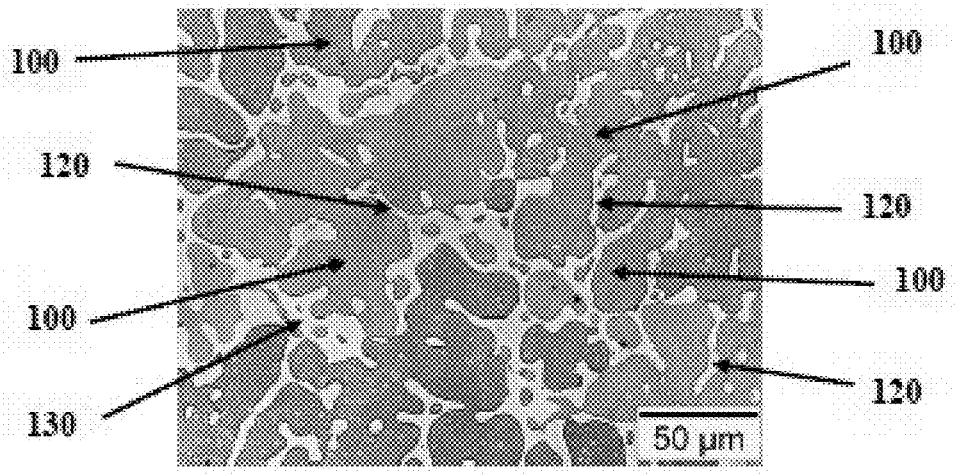
Figure 3C:
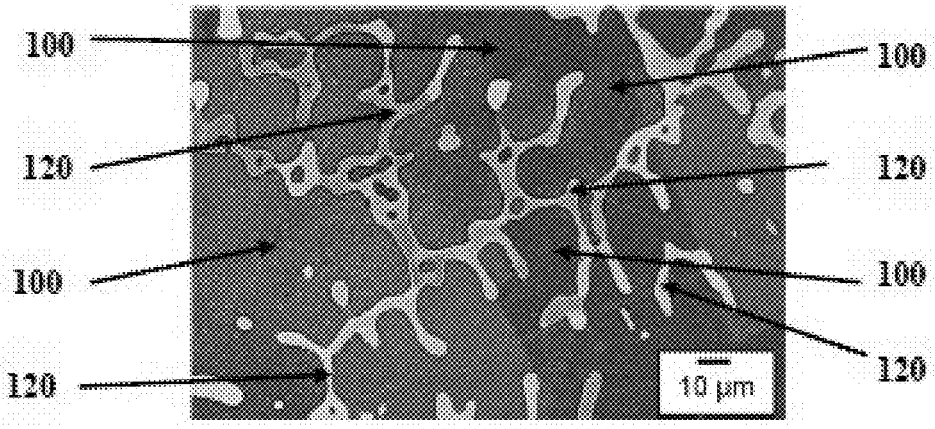
FIG. 3C is a scanning electron micrographic image of a dual-phase β+γ microstructure in a cobalt-nickel-aluminum SMA in accordance with the present invention.

FIGS. 3A and 3B shows optical, and FIG. 3C shows SEM, images of some characteristic areas in this SMA. A second phase γ is semi-continuous along β grain boundaries, with an average precipitate width of a few micrometers. There are also some γ islands as well as extremely fine γ particles precipitated within the grains. The thermal treatment applied to our alloy was carried out at an intermediate temperature (1100° C.) with respect to the temperature range, approximately 900-1350° C., in which β+γ equilibrium exists. At higher temperatures in this example, nucleation was difficult and nuclei preferentially formed heterogeneously at grain boundaries. The growth rate was high, and grain boundary precipitates were able to grow large. At lower temperatures, the nucleation rate was high even within grains and many stable nuclei formed inside grains but did not grow very large in size. Thus at an intermediate temperature, in addition to the coarser γ some of which precipitated along grain boundaries, many small particles of γ formed within grains.

A grain orientation EBSD map for an area in this example showed fine γ dispersions of precipitates inside grains are generally so small that EBSD was unable to detect the phases present. From EBSD results, a phase volume fraction of β is ~79% and that of γ is ~21% (excluding unidentified pixels). Some of the γ phase precipitates along a single grain boundary have more than one crystallographic orientation. γ precipitates within a single grain sometimes also have different orientations. Referring to FIG. 3A, coarse precipitates in grain interiors tended to form parallel semi-continuous slabs. β and γ with different crystal structures may be separated by coherent/semi-coherent interfaces with low mobility, which may migrate by a ledge mechanism, or high-mobility incoherent interfaces. A large number of precipitates in FIG. 3A-3C have tip morphologies indicative of incoherent interfaces, which can advance quickly along a plane of good atomic matching if there is a lack of ledges to advance coherent/semi-coherent interfaces. Semi-continuous precipitates also formed along grain boundaries, and as their broad faces were mostly curved and likely to be incoherent, their growth is diffusion-controlled. Solute collected at and diffused along grain boundaries and precipitate growth was facilitated by diffusion of solute along β/γ interfaces, which accelerated particle thickening. The thickness of grain boundary precipitates in FIGS. 3A-3C varied from ~2 μm to nearly 10 μm. Isolated planar incoherent nuclei on a grain boundary sometimes grew into one another via diffusion-controlled growth and form a slab of γ precipitate along a grain boundary 130, as seen in FIG. 3B.

Nanoindentation Behavior of Dual-Phase SMAs

The sample for this Example had an $A_f \approx -21°$ C. At a testing temperature of room temperature, ~25° C., the sample for this Example was in the austenitic state. Knowing $M_s \approx -45°$ C., the critical stress for stress-induced martensitic transformation in our sample was estimated. The Clausius-Clapeyron slope (i.e. the slope in the stress-temperature phase diagram for austenite and martensite) is approximately 2-3 MPa/° C. The estimated critical stress, $\sigma_c \approx$(2-3 MPa/° C.)·(25° C.−$M_s$)≈140-210 MPa, is well below the reported range of yield stresses for Co—Ni—Al, ~0.6-1.2 GPa. Therefore martensitic transformation should be initiated in this Example sample when the local stress exceeds $\sigma_c$.

In contrast with uniaxial mechanical testing, which applies a uniform load throughout a cross-section of a sample, in nanoindentation, a very small volume of material is indented and experiences non-uniform stresses at a given applied load. As austenite β is indented to a relatively low load above $A_f$, part of the volume undergoes stress-induced martensitic transformation, and reverts to austenite β when the load is removed. An impression of the indenter tip corresponding to unrecovered plastic deformation remains in the material after unloading. The displacement recovered during unloading cannot be attributed to elastic recovery alone, but possibly includes the component of superelastic recovery as well. Accordingly, recovered displacement $h_p - h_r$ may be decomposed, where $h_p$ is the depth at peak load $P_m$ and $h_r$ is depth at zero load (after unloading), into elastic recovery $h_{er} = P_m/S$, with S being the initial unloading slope, and superelastic recovery $h_{sr} = h_p - h_r - P_m/S$. The total strain recovery $\varepsilon_r$ and superelastic strain recovery $\varepsilon_{sr}$ are:

$$\varepsilon_r = \frac{h_p - h_r}{h_p} \tag{1}$$

$$\varepsilon_{sr} = \frac{h_{sr}}{h_p} = \frac{h_p - h_r - P_m/S}{h_p} \tag{2}$$

Nanoindentation hardness H is determined as:

$$H = P_m/A \tag{3}$$

where A is the resultant projected area of contact at peak load $P_m$, calculated using an area function for the Berkovich tip provided in the TRIBOINDENTER® software.

$$A = C_0 h_c^2 + C_1 h_c + C_2 h_c^{\frac{1}{2}} + C_3 h_c^{\frac{1}{4}} + C_4 h_c^{\frac{1}{8}} + C_5 h_c^{\frac{1}{16}} \tag{4}$$

where the contact depth $h_c = h_p - \varepsilon P_m/S$ and is given in nm, with the geometric constant ε taken to be 0.75; $C_0$=24.50, $C_1 = -2.80\times10^3$, $C_2 = 3.23\times10^5$, $C_3 = -2.74\times10^6$, $C_4 = 6.06\times10^6$, and $C_5 = -3.61\times10^6$. The fraction of energy dissipated during indentation, $E_d$, is determined by calculating the area within the indentation load P-displacement h curve divided by the area under the loading portion of the curve. Plastic work is dissipated as heat ($E_d$ is 100%). Martensitic transformation is a dissipative process, but recovers the transformation strain during reverse transformation at a much lower stress; accordingly, its $E_d$ is non-zero but is much less than 100%. Purely elastic deformation does not dissipate energy and is fully recovered upon unloading ($E_d$=0%). Therefore, the magnitude of $E_d$ reveals dominant deformation mechanism (s) among the three.

Figure 4A:
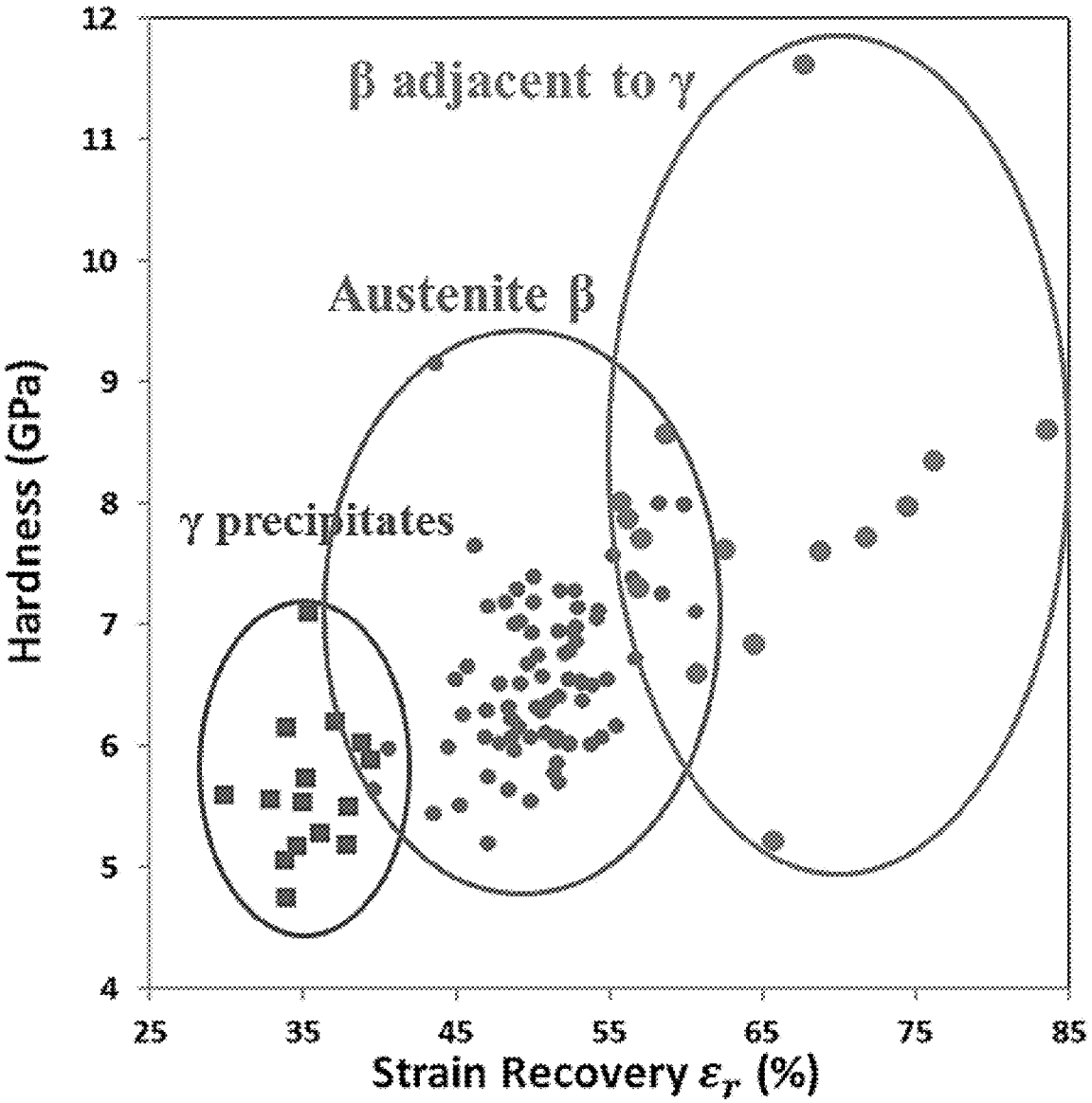
FIGS. 4A-4B are graphs depicting hardness versus total strain recovery (A) and energy dissipation versus superelastic recovery (B) of different regions of an SMA in accordance with the present invention.

Nanoindentation results acquired from six austenite β Grains (austenite β Grains 1-6) and γ precipitates with different orientations were obtained. Some of the indents were made in austenite β, some were positioned inside β but at what are believed to be β/γ phase boundaries, while others were made inside non-transforming γ precipitates. Some indents inside β grains were believed to be located at phase boundaries between β and fine γ precipitates FIG. 4A shows a hardness H-strain recovery $\varepsilon_r$ map for all the indents made in the current Example sample. Hardness values for γ were 4.7-7.1 GPa. Some values of H in γ were similar to low range of H values in austenite β, which could be due to material anisotropy. In β, H≈5.2-9.2 GPa. In comparison, the nanohardness is ~7 GPa in martensite in a dual-phase steel, 3-5 GPa in non-transforming (B2) Ni—Al, and 3-6 GPa in austenite (B2) Ni—Ti. At β/γ interfaces in austenite β, H=6.6-11.6 GPa, the highest range of all three regions, suggesting local hardening at β/γ interfaces. Strain recovery $\varepsilon_r$ in γ was approximately 30-39%, while in austenite β, it was much higher and is 40-61%. Overall, β regions at β/γ interfaces had the highest $\varepsilon_r$ of 56-84%. Since γ does not transform martensitically, it plastically deforms when the stress exceeds its yield point. As a result, γ overall had lower strain recovery $\varepsilon_r$. β/γ regions had the highest $\varepsilon_r$ possibly due to their higher superelastic recovery $\varepsilon_{sr}$ and possibly higher elastic strain recovery $\varepsilon_{er}$ as well, which can most likely be attributed to the presence of γ reducing plastic deformation in neighboring β. There was a large spread in H and $\varepsilon_r$ values at β/γ interfaces, probably because of the variations in distances of indents from γ precipitates as well as grain orientation effects.

Figure 4B:
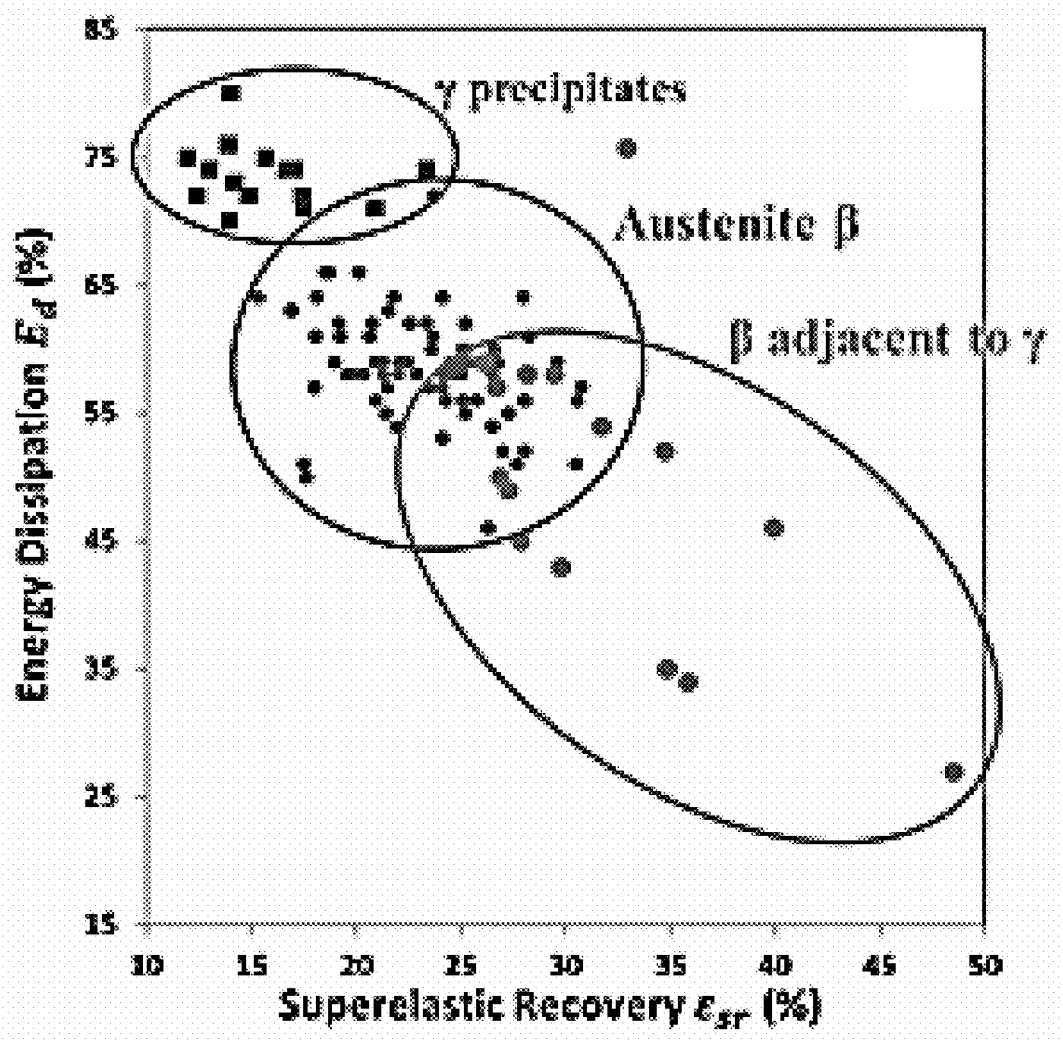

FIG. 4B summarizes all indentation data in a percent energy dissipation $E_d$-superelastic recovery $\varepsilon_{sr}$ map. Superelastic recovery $\varepsilon_{sr}$≈12-23% in γ and was higher in austenite β (~15-31%), and the highest at β/γ interfaces (~26-48%). The energy dissipation $E_d$ in γ is 70-80%, higher than that in austenite β, which was 46-72%, while at β/γ interfaces, $E_d$ was 27-59%. As expected for a non-transforming second phase, γ had the lowest $\varepsilon_{sr}$ overall and the highest $E_d$ due to extensive unrecoverable plastic deformation. $E_d$ in β was lower than that in γ because although martensitic transformation in β is an energy dissipating process, it does not dissipate as high a fraction of energy as plastic deformation in non-transforming γ. Overall, β/γ regions had the highest $\varepsilon_{sr}$ and the lowest $E_d$, indicating that they had enhanced superelastic properties and reduced extent of plastic deformation with respect to austenite β. The mechanical interactions between γ and martensitic transformation in β might also affect the dissipation associated with transformation itself.

These effects at β/γ interfaces corroborate that the presence of γ in the vicinity of β enhanced superelasticity and strain recovery during stress-induced martensitic transformation in nanoindentation tests. There is local strengthening at the β/γ interface. Additionally, γ accommodates transformation strain in nearby β by extensive plastic deformation, alleviating stress concentration beneath the indenter. The plastic accommodation by γ also relieves the constraint imposed on transforming β and decreases the energy barrier for transformation. As a result, less material deforms plastically and more transforms martensitically, improving superelastic properties in β adjacent to γ.

Additional Examples of SMA's were manufactured according to the foregoing procedure, but with different component metals, temperature exposures and durations, and ramp rates, as specified below.

Example 2

Figure 5A:
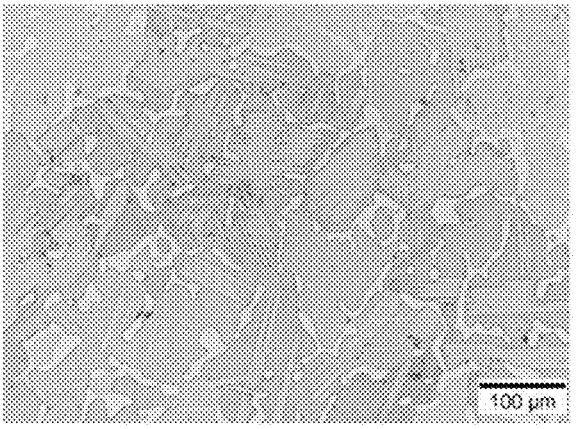
FIGS. 5A-5X are optical images of dual-phase microstructures in several SMAs constructed in accordance with the present invention as further described herein.

An alloy made of $Co_{37}Ni_{35.5}Al_{27.5}$ at % received thermal treatment at 1200° C. for 24 hours, ramped up from room temperature (25° C.) at a rate of 1.5° C./min with the alloy present in the furnace. Large γ precipitates formed along grain boundaries semi-continuously, with a few large γ precipitates inside grains, in a partially martensitic microstructure ($M_s$=45° C., $M_f$=8° C., $A_s$=25° C., and $A_f$=70° C.). A representative microstructure of this Example is shown in FIG. 5A.

Example 3

Figure 5B:
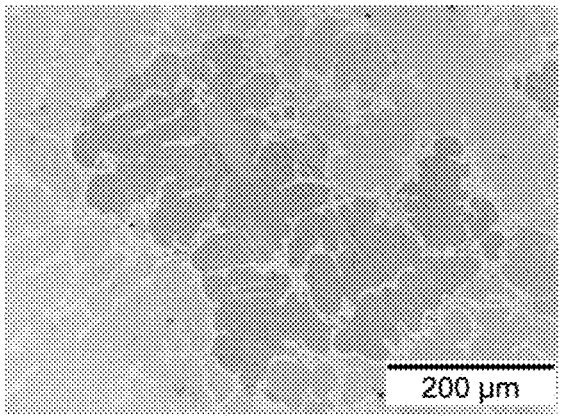

An alloy made of $Co_{37}Ni_{35.5}Al_{27.5}$ at % received thermal treatment at 1175° C. for 8 hours, ramped up from room temperature (25° C.) at a rate of 2.5° C./min with the alloy present in the furnace. Some growth of γ occurred inside grains and tended to form long, narrow precipitates. Some grains contained martensite but the majority of grains were austenitic ($M_s$=−5° C., $M_f$=−60° C., $A_s$=−25° C., and $A_f$=20° C.). A representative microstructure of this Example is shown in FIG. 5B.

Example 4

Figure 5C:
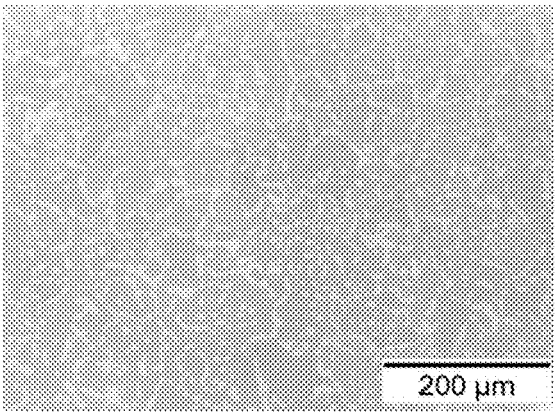

An alloy made of $Co_{38}Ni_{34.3}Al_{27.7}$ at % received thermal treatment at 1250° C. for 8 hours, ramped up from room temperature (25° C.) at a rate of 1.5° C./min with the alloy present in the furnace. Nearly continuous, thick γ precipitated along grain boundaries and a few large, round γ precipitates also formed inside grains ($M_s$=−52° C., $M_f$=−77° C., $A_s$=−55° C., and $A_f$=−15° C.). A representative microstructure of this Example is shown in FIG. 5C.

Example 5

Figure 5D:
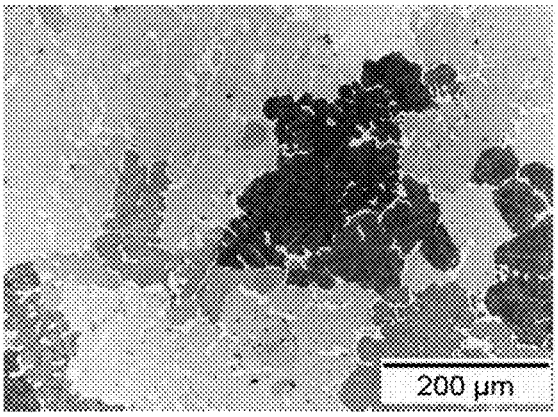

An alloy made of $Co_{38}Ni_{34.3}Al_{27.7}$ at % received thermal treatment at 1300° C. for 4 hours, ramped up from room temperature (25° C.) at a rate of 2.0° C./min with the alloy present in the furnace. Very thin, semi-continuous γ along grain boundaries and some γ precipitates growing inward towards the center of grains was formed ($M_s$=−30° C., $M_f$=−80° C., $A_s$=−58° C., and $A_f$=−21° C.). A representative microstructure of this Example is shown in FIG. 5D.

Example 6

Figure 5E:
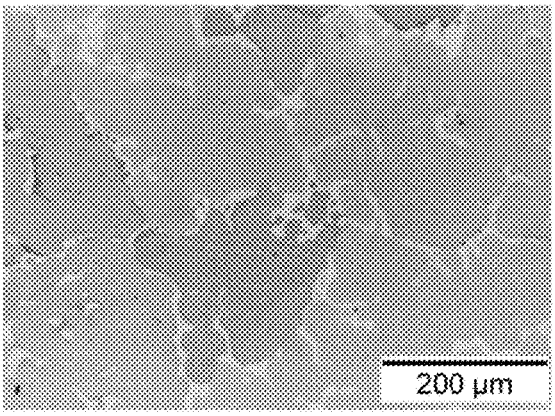

An alloy made of $Co_{38}Ni_{34.3}Al_{27.7}$ at % received thermal treatment at 1300° C. for 3.75 hours, ramped up from room temperature (25° C.) at a rate of 2.5° C./min with the alloy present in the furnace. The resulting SMA had a partially martensitic, semi-continuous, thin γ precipitated along grain boundaries, and almost no γ inside grains ($M_s$=30° C., $M_f$=−20° C., $A_s$=5° C., and $A_f$=47° C.). A representative microstructure of this Example is shown in FIG. 5E.

Example 7

Figure 5F:
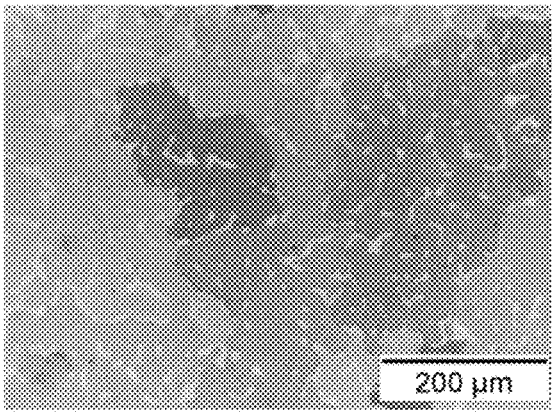

An alloy made of $Co_{38}Ni_{34.3}Al_{27.7}$ at % received thermal treatment at 1260° C. for 6 hours, ramped up from room temperature (25° C.) at a rate of 2.5° C./min with the alloy present in the furnace. The resulting SMA had an austenitic microstructure and more γ precipitated inside grains than for Example 6. γ also precipitated semi-continuously along grain boundaries ($M_s$=−23° C., $M_f$=−−68° C., $A_s$=−45° C., and $A_f$=10° C.). A representative microstructure of this Example is shown in FIG. 5F.

Example 8

Figure 5G:
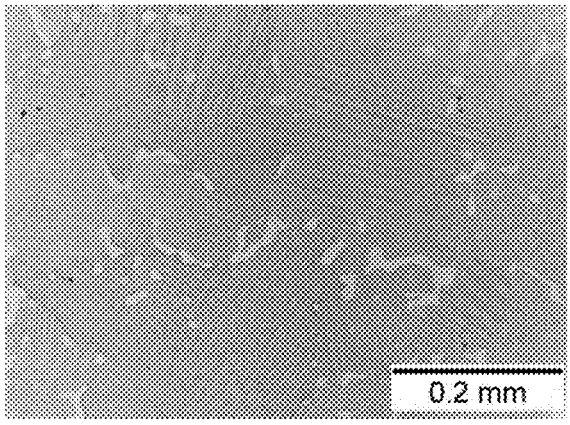

An alloy made of $Co_{38}Ni_{34.3}Al_{27.7}$ at % received thermal treatment at 1325° C. for 3.5 hours, ramped up from room temperature (25° C.) at a rate of 2.5° C./min with the alloy present in the furnace. The resulting SMA was martensitic at room temperature, and very little γ precipitated along grain boundaries and almost no γ precipitated inside grains ($M_s$=75° C., $M_f$=32° C., $A_s$=55° C., and $A_f$=100° C.). A representative microstructure of this Example is shown in FIG. 5G.

Example 9

Figure 5H:
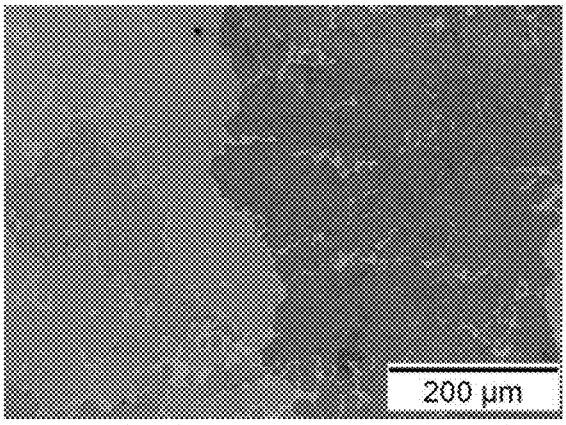

An alloy made of $Co_{38}Ni_{343}Al_{27.7}$ at % received thermal treatment at 1200° C. for 2 hours, ramped up from room temperature (25° C.) at a rate of 3.0° C./min with the alloy present in the furnace. The resulting SMA was austenitic at room temperature, with relatively substantial γ precipitated inside grains with a thin layer along grain boundaries ($M_s$=−37° C., $M_f$=−80° C., $A_s$=−45° C., and $A_f$=−15° C.). A representative microstructure of this Example is shown in FIG. 5H.

Example 10

Figure 5I:
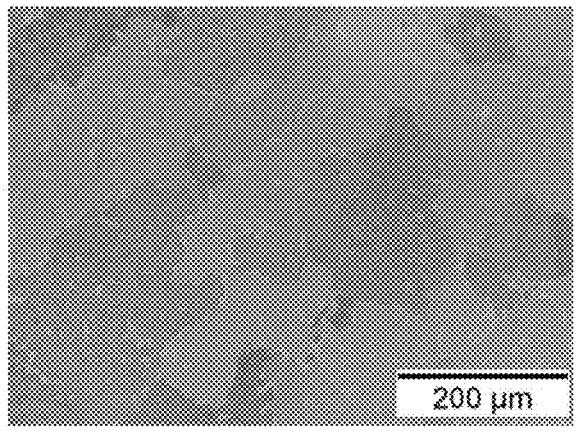

An alloy made of $Co_{38}Ni_{343}Al_{27.7}$ at % received thermal treatment at 1225° C. for 2 hours, ramped up from room temperature (25° C.) at a rate of 3.0° C./min with the alloy present in the furnace. The resulting SMA had a similar microstructure as did the SMA of Example 9 but γ was slightly more continuous along grain boundaries with substantial γ precipitated inside grains. A representative microstructure of this Example is shown in FIG. 5I.

Example 11

Figure 5J:
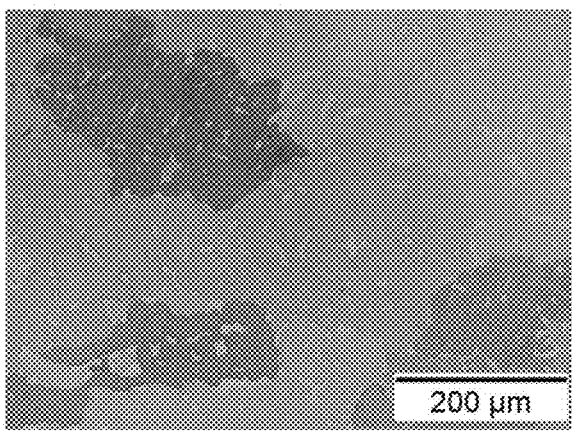

An alloy made of $Co_{38}Ni_{34.3}Al_{27.7}$ at % received thermal treatment at 1250° C. for 2 hours, ramped up from room temperature (25° C.) at a rate of 3.0° C./min with the alloy present in the furnace. The resulting SMA had the following transformation temperatures: $M_s$=0° C., $M_f$=−35° C., $A_s$=−17° C., and $A_f$=20° C. A representative microstructure of this Example is shown in FIG. 5J.

Example 12

Figure 5K:
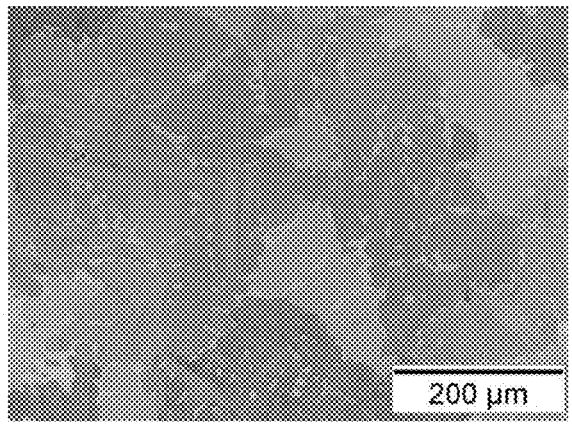

An alloy made of $Co_{38}Ni_{34.3}Al_{27.7}$ at % received thermal treatment at 1260° C. for 2 hours, ramped up from room temperature (25° C.) at a rate of 3.0° C./min with the alloy present in the furnace. The resulting SMA was partially martensitic at room temperature. Martensite was likely stress induced during polishing. The sample had the following transformation temperatures: $M_s$=−10° C., $M_f$=−50° C., $A_s$=−20° C., and $A_f$=23° C. A representative microstructure of this Example is shown in FIG. 5K.

Example 13

Figure 5L:
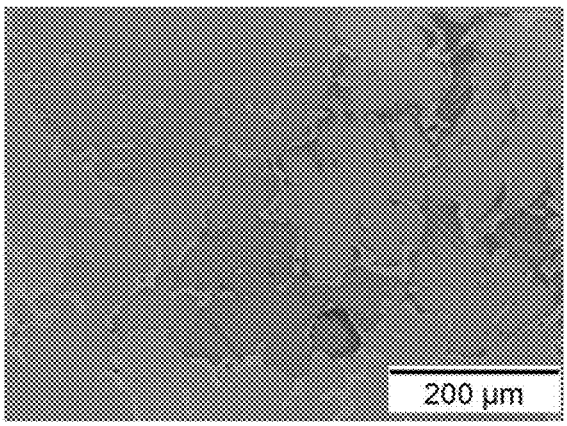

An alloy made of $Co_{38}Ni_{34.3}Al_{27.7}$ at % received thermal treatment at 1280° C. for 4.75 hours, ramped up from room temperature (25° C.) at a rate of 3.0° C./min with the alloy present in the furnace. The resulting SMA displayed a partially martensitic microstructure, with semi-continuous γ along grain boundaries. Very little γ precipitated inside grains. $M_s$=0° C., $M_f$=−25° C., $A_s$=7° C., and $A_f$=35° C. A representative microstructure of this Example is shown in FIG. 5L.

Example 14

Figure 5M:
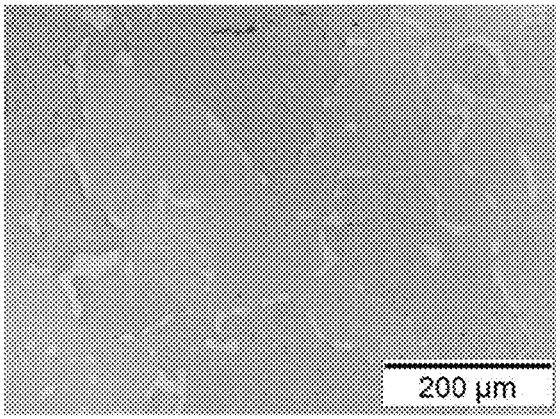

An alloy made of $Co_{38}Ni_{34.3}Al_{27.7}$ at % received thermal treatment at 1300° C. for 12 hours, ramped up from room temperature (25° C.) at a rate of 3.0° C./min with the alloy present in the furnace. The resulting SMA displayed a partially martensitic structure, similar to Example 13 with slightly more continuous γ precipitation. $M_s$=50° C., $M_f$=15° C., $A_s$=40° C., and $A_f$=65° C. A representative microstructure of this Example is shown in FIG. 5M.

Example 15

Figure 5N:
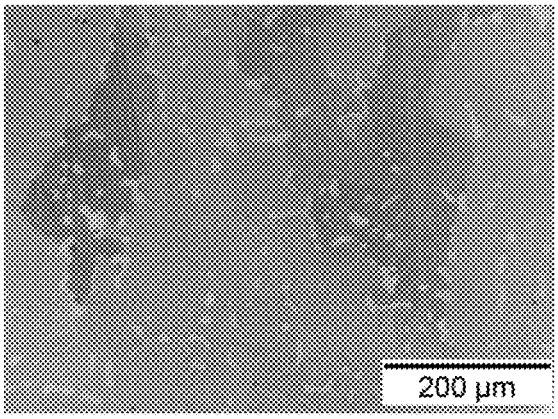

An alloy made of $Co_{38.5}Ni_{33.5}Al_{28}$ at % received thermal treatment at 1300° C. for 3 hours, ramped up from room temperature (25° C.) at a rate of 3.0° C./min with the alloy present in the furnace. The resulting SMA displayed a partially martensitic microstructure, with elongated grains and non-continuous γ precipitation along grain boundaries and relatively little γ precipitated inside grains. $M_s$=8° C., $M_f$=−40° C., $A_s$=−17° C., and $A_f$=28° C. A representative microstructure of this Example is shown in FIG. 5N Example 16

Figure 5O:
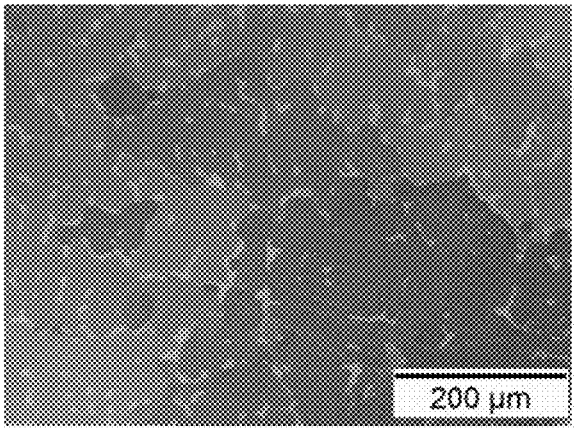

An alloy made of $Co_{38.5}Ni_{33.5}Al_{28}$ at % received thermal treatment at 1260° C. for 2 hours, ramped up from room temperature (25° C.) at a rate of 3.0° C./min with the alloy present in the furnace. The resulting SMA displayed some martensite visible inside grains and substantial γ precipitation inside grains but also substantial distribution of semi-continuous γ along grain boundaries. $M_s$=−25° C., $M_f$=−60° C., $A_s$=−40° C., and $A_f$=−3° C. A representative microstructure of this Example is shown in FIG. 5O.

Example 17

Figure 5P:
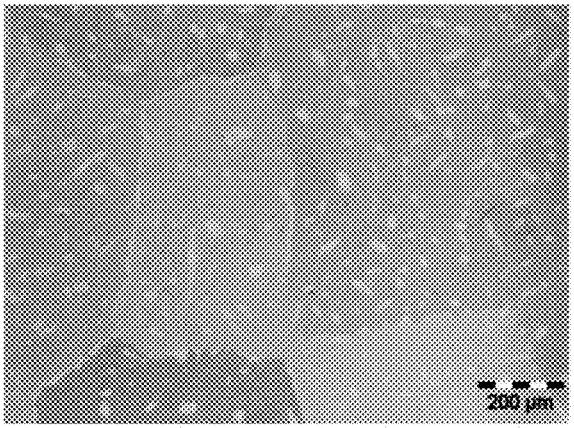

An alloy made of $Co_{38.5}Ni_{33.5}Al_{28}$ at % received thermal treatment at 1375° C. for 1 hour followed by thermal treatment at 1240° C. for 2 hours, with furnace temperature ramped up to 1375° C. from room temperature (25° C.) and from 1375° C. to 1240° C. at a rate of 3.0° C./min with the alloy present in the furnace. The resulting SMA displayed the following thermal transformation temperatures: $M_s$=−25° C., $M_f$=−60° C., $A_s$=−45° C., and $A_f$=−6° C. A representative microstructure of this Example is shown in FIG. 5P.

Example 18

Figure 5Q:
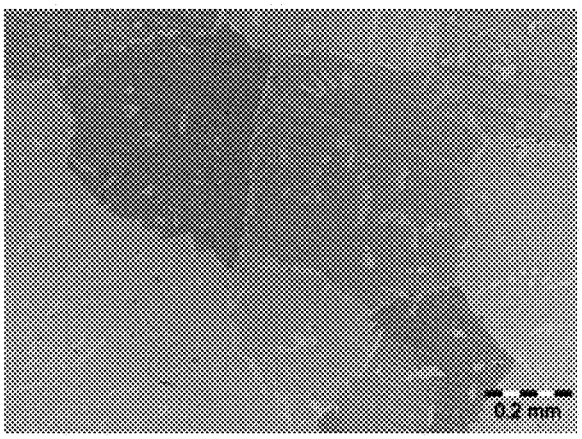

An alloy made of $Co_{38.5}Ni_{33.5}Al_{28}$ at % received thermal treatment at 1375° C. for 1.5 hour followed by thermal treatment at 1240° C. for 45 min, with furnace temperature ramped up to 1375° C. from room temperature (25° C.) at a rate of 3.0° C./min and from 1375° C. to 1240° C. at a rate of 1.5° C./min with the alloy present in the furnace. The resulting SMA displayed the following thermal transformation temperatures: $M_s$=−15° C., $M_f$=−55° C., $A_s$=−32° C., and $A_f$=4° C. A representative microstructure of this Example is shown in FIG. 5Q.

Example 19

Figure 5R:
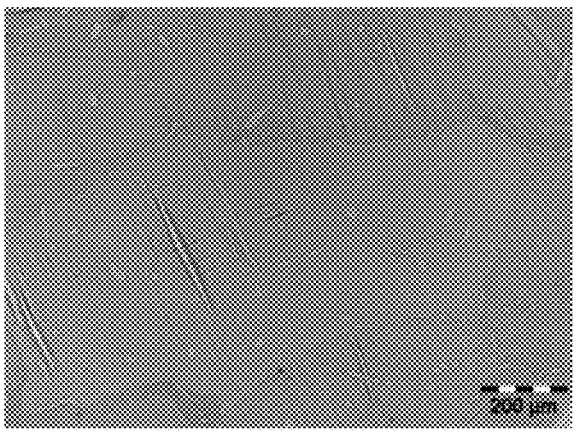

An alloy made of $CO_{38.5}Ni_{33.5}Al_{28}$ at % received thermal treatment at 1375° C. for 1.5 hour (with furnace temperature ramped up to 1375° C. from room temperature (25° C.) at a rate of 3.0° C./min with the alloy present in the furnace) followed by a ramp-down of temperature at a rate of 1.1° C./min until a furnace temperature of 1275° C. was obtained, followed by quenching the SMA. The resulting SMA displayed the following thermal transformation temperatures: $M_s$=35° C., $M_f$=−3° C., $A_s$=18° C., and $A_f$=57° C. A representative microstructure of this Example is shown in FIG. 5R.

Example 20

Figure 5S:
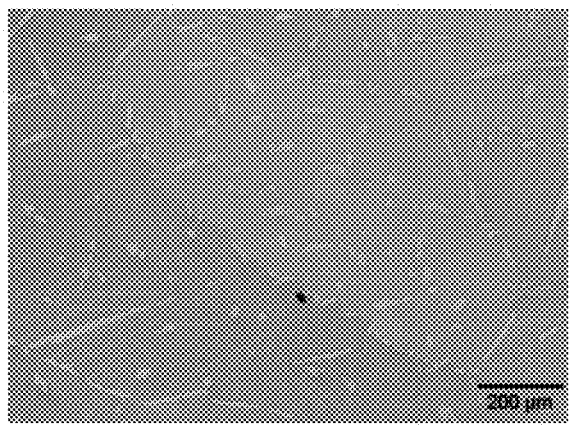

An alloy made of $Co_{38.5}Ni_{33.5}Al_{28}$ at % received thermal treatment at 1375° C. for 1.5 hour (with furnace temperature ramped up to 1375° C. from room temperature (25° C.) at a rate of 3.0° C./min with the alloy present in the furnace) followed by a ramp-down of temperature at a rate of 1.4° C./min until a furnace temperature of 1225° C. was obtained, followed by a dwell time of 30 min at 1225° C. then quenching the SMA. The resulting SMA displayed the following thermal transformation temperatures: $M_s$=−3° C., $M_f$=−50° C., $A_s$=−25° C., and $A_f$=15° C. A representative microstructure of this Example is shown in FIG. 5S.

Example 21

Figure 5T:
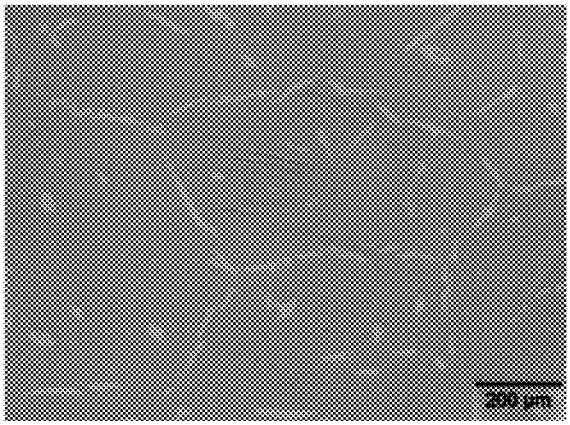

An alloy made of $Co_{38.5}Ni_{33.5}Al_{28}$ at % received thermal treatment at 1375° C. for 1.5 hour (with furnace temperature ramped up to 1375° C. from room temperature (25° C.) at a rate of 3.0° C./min with the alloy present in the furnace) followed by a ramp-down of temperature at a rate of 0.9° C./min until a furnace temperature of 1275° C. was obtained, followed by a dwell time of 20 min at 1275° C. then quenching the SMA. The resulting SMA displayed the following thermal transformation temperatures: $M_s$=15° C., $M_f$=−30° C., $A_s$=−20° C., and $A_f$=30° C. A representative microstructure of this Example is shown in FIG. 5T.

Example 22

Figure 5U:
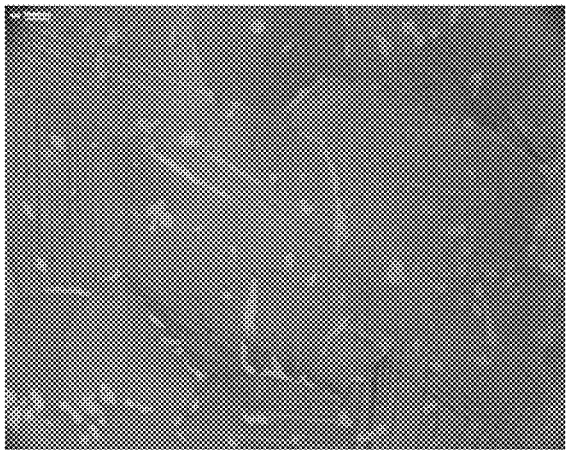

An alloy made of $CO_{38.5}Ni_{33.5}Al_{28}$ at % received thermal treatment at 1375° C. for 75 min (with furnace temperature ramped up to 1375° C. from room temperature (25° C.) at a rate of 3.0° C./min with the alloy present in the furnace) followed by a ramp-down of temperature at a rate of 0.7° C./min until a furnace temperature of 1285° C. was obtained, followed quenching the SMA. The resulting SMA displayed less continuous γ precipitation along grain boundaries and more γ precipitates inside grains as compared to Example 21. A representative microstructure of this Example is shown in FIG. 5U.

Example 23

Figure 5V:
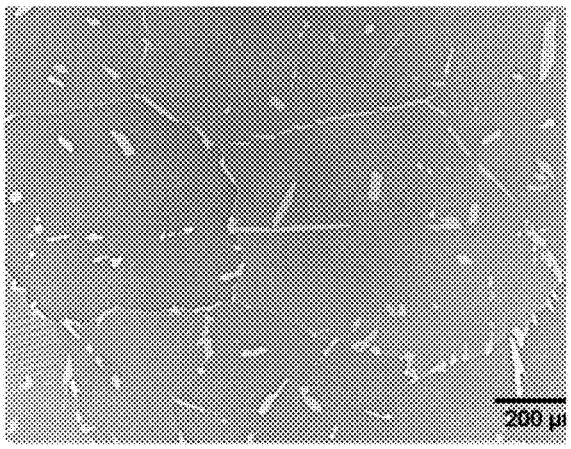

An alloy made of $Co_{38.5}Ni_{33.5}Al_{28}$ at % received thermal treatment at 1375° C. for 1.5 hour (with furnace temperature ramped up to 1375° C. from room temperature (25° C.) at a rate of 3.0° C./min with the alloy present in the furnace) followed by a ramp-down of temperature at a rate of 1.1° C./min until a furnace temperature of 1275° C. was obtained, followed quenching the SMA. This heat treatment promoted γ precipitate growth along grain boundaries without significant nucleation of precipitates inside austenite grains. γ predominantly precipitated along grain boundaries and formed a nearly continuous layer along many grain boundaries. A representative microstructure of this Example is shown in FIG. 5V.

γ precipitates formed along grain boundaries and did not necessarily have the same orientation along a given grain boundary. Some stretched continuously for 50-100 nm, sometimes continuously for almost the entire length of a grain boundary. Other grain boundaries had γ precipitated semi-continuously.

Example 24

Figure 5W:
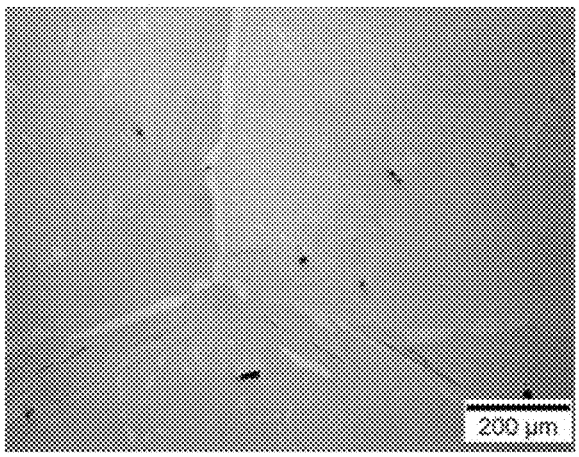

This Example used an SMA made of $Cu_{70}Zn_{26}Al_4$ wt %, in which a face-centered-cubic crystal structure solid solution phase precipitates into austenite β within a temperature range of approximately 420-780° C. Optimized microstructures for $Cu_{70}Zn_{26}Al_4$ wt % were obtained from thermal treatments carried out with dwell temperatures of 600° C.-700° C. for less than 10 hours. Samples heat treated at 615-640° C. for 4-5 hours showed nearly continuous α precipitates forming a layer along grain boundaries. A representative microstructure of a sample heat treated at 640° C. for 4 hrs and with ramping rate of 4° C./min is shown in FIG. 5W.

Example 25

Figure 5X:
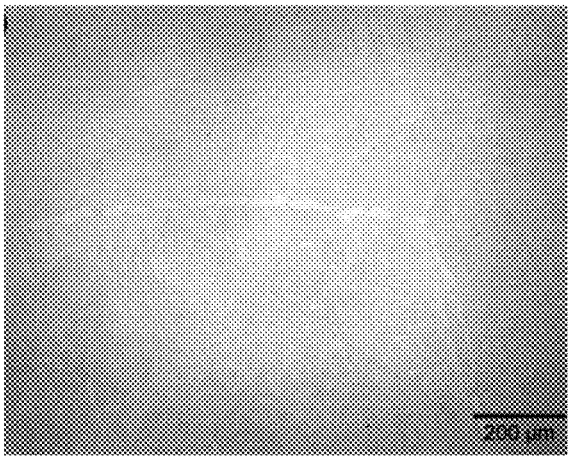

A cast ingot of $Cu_{86}Al_{11}Ni_3$ wt % was purchased from American Elements for use in this Example. In $Cu_{86}Al_{11}Ni_3$ wt %, a face-centered-cubic crystal structure solid solution phase (FCC) is in equilibrium with austenite β from approximately 675° C. to 900° C. For this Example, thermal treatments between 700° C.-800° C. proved to produce microstructures with more continuous precipitates. A thermal treatment including ramping to 725° C. at 2.5° C./min and holding for 8 hours resulted in the microstructure with continuous FCC along grain boundaries and few precipitates inside grains. A similar thermal treatment but with a sample inserted in a furnace preheated to 730° C. and dwell period of 8 hrs resulted in a microstructure where relatively continuous FCC precipitates were present in grain boundaries. A representative microstructure of this Example is shown in FIG. 5X. While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

What is claimed is:

1. A method of making a polycrystalline shape memory alloy comprising:

forming a cobalt-nickel-aluminum polycrystalline shape memory alloy wherein the alloy comprises a matrix of grains and a plurality of grain boundaries, wherein the plurality of grain boundaries comprise a plurality of interfaces between adjacent grains;

ramping from an initial temperature of about 25° C. to a dwell temperature at a rate of about 1.5° C./minute;

exposing the alloy to the dwell temperature for about 24 hours under an atmosphere of about 99% argon and about 1% hydrogen, the dwell temperature being about 1150° C.;

precipitating a cobalt-nickel-aluminum polycrystalline shape memory alloy microstructure comprising between about 18 weight % and about 20 weight % of a face centered cubic phase γ in equilibrium with an austenitic phase β, the cobalt-nickel-aluminum polycrystalline shape memory alloy having a first strain energy recovery of the face centered cubic phase γ between about 30% and about 39%, a second strain energy recovery of the austenitic phase β between about 40% and about 61%, and a third strain energy recovery of the austenitic phase β in proximity to an β/γ phase interface region between about 56% and about 84%; and quenching the alloy.

2. The method of claim 1, wherein the cobalt-nickel-aluminum polycrystalline shape memory alloy has a first superelastic recovery of the face centered cubic phase γ between about 12% and about 23%, a second superelastic recovery of the austenitic phase β between about 15% and about 31%, and a third superelastic recovery of the β/γ interface region between about 26% and about 48%.

3. The method of claim 1, wherein the cobalt-nickel-aluminum polycrystalline shape memory alloy has a first energy dissipation of the face centered cubic phase γ between about 70% and about 80%, a second energy dissipation of the austenitic phase β between about 46% and about 72%, and a third energy dissipation of the β/γ interface region between about 27% and about 59%.

4. The method of claim 1, wherein the cobalt-nickel-aluminum polycrystalline shape memory alloy has a martensitic start temperature about −45 ° C., a martensitic finish temperature about 80° C., an austenitic start temperature about −50° C. and an austenitic finish temperature about −20° C.

5. The method of claim 1, wherein the cobalt-nickel-aluminum polycrystalline shape memory alloy comprises about $Co_{37\%}Ni_{35.5\%}Al_{27.5\%}$.

* * * * *